US005287573A

United States Patent [19]

Ritacco

[11] Patent Number: 5,287,573

[45] Date of Patent: Feb. 22, 1994

[54] DIVIDED BED SHEETS FOR DOUBLE BEDS

[76] Inventor: Susan C. Ritacco, 3 Edgewood Dr., Holmdel, N.J. 07733

[21] Appl. No.: 37,311

[22] Filed: Mar. 26, 1993

[51] Int. Cl.[5] ..... A47G 9/02

[52] U.S. Cl. ..... 5/486

[58] Field of Search ..... 5/486, 482, 495, 497

[56] References Cited

U.S. PATENT DOCUMENTS 3,072,776 1/1963 Quenneville ..... 5/486
3,331,088 7/1967 Marquette ..... 5/486
3,508,285 4/1970 Marquette ..... 5/486
3,530,516 9/1970 Marquette ..... 5/486
4,802,251 2/1989 O'Dell ..... 5/486

*Primary Examiner*—Alexander Grosz
*Attorney, Agent, or Firm*—Charles I. Brodsky

[57] ABSTRACT

Each of a color-coordinated fitted bed sheet and its overling flat bed sheet are composed of a flannel material and of a cotton-polyester blend material joined into two halves running along their respective lengths. The flannel-half sheets are preferable for use by those desiring warmth during the colder months of the year, while the cotton-polyester blend-half sheets are preferable for use by their bed partner desiring a cooler feeling.

6 Claims, 1 Drawing Sheet

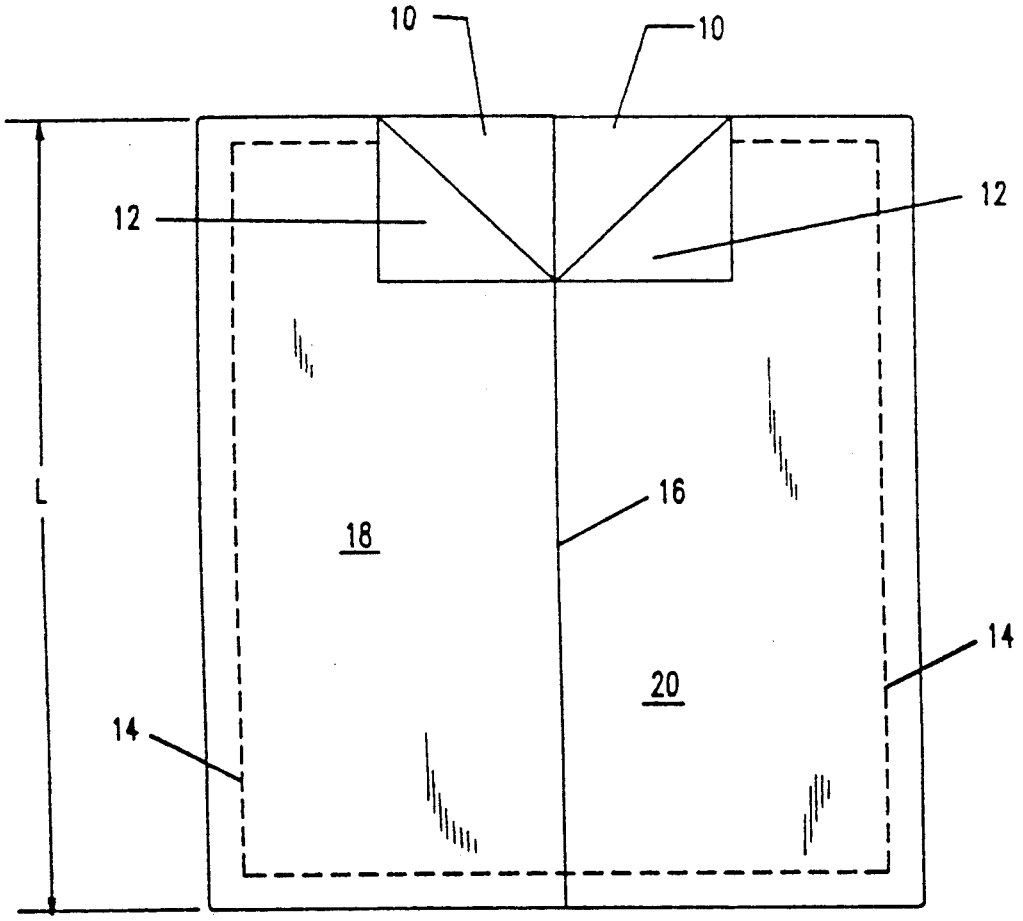
10
10
12
12
L
16
18
20
14
14

DIVIDED BED SHEETS FOR DOUBLE BEDS

FIELD OF THE INVENTION

This invention relates to double bed coverings, in general, and to divided bed sheets for such double beds, in particular.

BACKGROUND OF THE INVENTION

As is well known and understood, the two occupants of a double bed oftentimes have different warmth requirements.

For such reasons, proposals have been made in the past for designing blankets having, for example, different warmth capabilities as to one-half of the blanket, as compared to the other. Some such arrangements as have previously been patented have been described as utilizing interchangeable halves, while others have dealt with blanket constructions having multiple panels having different and interchangeable warmth features.

While such constructions have worked quite capably in locales of severe cold, different occupants of the double bed have been noted to continue to experience different warmth needs when residing in locales where the temperature extremes of coldness are not as severe. In those instances, the use of divided double bed blankets is not as acute.

SUMMARY OF THE INVENTION

As will become clear from the description that follows, the present invention satisfies the needs of double bed occupants in a less severe climate—and even useful where temperatures are extreme —through the use of fitted and flat bed sheets offering different warmth characteristics for double bed use. In particular, and as will be described below, each of a color-coordinated fitted bed sheet and its overlying flat bed sheet, according to the invention, are composed of a flannel material and a cotton-polyester blend material joined into two halves running along their respective lengths. As described, the flannel-half sheets are preferable for use by those desiring warmth during the cooler months of the year, while the cotton-polyester blend-half sheets are preferable for use by their bed partners desiring a cooler feeling. As will be more clearly and specifically described, each of the fitted and flat sheets is composed of a separate flannel and cotton-polyester blend material section, joined into half portions running along their respective lengths. Such half-portions may be sewn together for use, or otherwise attached together, as desired. In similar manner, a flannel pillow case can be employed coordinated with those sheet-halves likewise composed of flannel, while a corresponding cotton-polyester blend pillow case can be employed to coordinate with the fitted and flat half portion fabricated from the cotton-polyester blend.

BRIEF DESCRIPTION OF THE DRAWING

These and other features of the present invention will be more clearly understood from a consideration of the following description, taken in connection with the sole FIGURE the drawing illustrating the fitted and flat sheet combination comprising the invention.

DETAILED DESCRIPTION OF THE DRAWINGS

Referring to the Drawing, reference numeral 10 identifies the fitted sheet of the invention, overlain with the flat sheet covering 12 (folded-over for ease of understanding). Reference numeral 14 identifies the usual elastic band which secures the fitted sheet about the mattress (not shown).

In accordance with the invention, each of the sheets 10, 12 are divided longitudinally in half, along the line 16, running along their respective lengths L. In further accordance with the invention, one-half—illustratively shown at 18—is composed substantially entirely of a flannel composition, while the other half, 20 is composed substantially only of a cotton-polyester blend material. Although composed of different materials in the two halves, both halves 18, 20 are color-coordinated with each other, and with any pillow cases to be used, each of them, again, being of a flannel or cotton-polyester blend to go along with the sheets employed, between which the occupant lies. In such manner, the occupants using the double bed could then decide whether the warmth characteristics of the flannel-type half 18 is more to his or her liking, than the cotton-polyester blend half 20, and fit between the sheets then according to individual preference. If the situation still warrants it, an overlying blanket of different warmth-characteristic halves could be further used, or one just used with a single warmth characteristic throughout. The two halves 18, 20 may then be joined together, as at 16, by sewing—although any other appropriate means of connection (e.g. by a zipper) may be utilized.

While there have been described what are considered to be preferred embodiments of the present invention, it will be readily apparent that other modifications can be made without departing from the scope of the teachings herein. Thus, whereas a cotton-polyester blend has been described as preferable for the fitted and flat sheets where the user desires a "cooler" warmth requirement than a "flannel" might exhibit, other materials could be used instead of cotton-polyester blends—and in a like manner, a material other than "flannel" could be employed for providing a "warmer" characteristic. For at least such reason, therefore, resort should be had to the claims appended hereto for a true understanding of the scope of the invention, noting that differing materials could be used consistent with the claim terminology, in providing different warmth characteristics to the two bed partners in a double bed use.

I claim:

1. In a double bed covering for two users desiring differing warmth characteristics;

a first fitted sheet, composed of a flannel section and a separate cotton-polyester blend material section affording differing warm the characteristics; and a second flat sheet overlying said first fitted sheet, similarly composed of a flannel section and a separate cotton-polyester blend material section affording differing warmth characteristic;

and with said flannel section and said cotton-polyester blend material section of each said sheet being permanently joined together along their respective lengths at an adjacent edge thereof all said sections being of generally similar sizes and shapes, whereby two uses of the double bed covering, lying side by side between the fitted and flat sheets could be accommodated.

2. The combination of claim 1, wherein each of said fitted and flat sheets are color coordinated.

3. The combination of claim 1, wherein each said fitted and flat sheet is divided into two half-portions, one of which is composed substantially entirely of said flannel composition and the other of which is composed substantially entirely of said cotton-polyester blend composition.

4. The combination of claim 3, wherein each of said two half portions are sewn together along their respective lengths.

5. The combination of claim 1, wherein said flannel and said cotton-polyester blend material sections of said first fitted sheet are color coordinated.

6. The combination of claim 1, wherein said fannel and said cotton-polyester blend material sections of said second flat sheet are color coordinated.

* * * * *